US011384506B2

(12) United States Patent
Manchester

(10) Patent No.: US 11,384,506 B2
(45) Date of Patent: Jul. 12, 2022

(54) TRENCH CUTTING APPARATUS AND METHOD

(71) Applicant: ROYAL IHC LIMITED, Stocksfield (GB)

(72) Inventor: Jonathan Ralph Manchester, Stocksfield (GB)

(73) Assignee: ROYAL IHC LIMITED, Northumderland (GB)

( * ) Notice: Subject to any disclaimer, the term of this patent is extended or adjusted under 35 U.S.C. 154(b) by 0 days.

(21) Appl. No.: 16/632,915

(22) PCT Filed: Jul. 24, 2018

(86) PCT No.: PCT/EP2018/070008
§ 371 (c)(1),
(2) Date: Jan. 22, 2020

(87) PCT Pub. No.: WO2019/020611
PCT Pub. Date: Jan. 31, 2019

(65) Prior Publication Data

US 2020/0165796 A1 May 28, 2020

(30) Foreign Application Priority Data

Jul. 27, 2017 (NL) ..... 2019360

(51) Int. Cl.
*E02F 5/10* (2006.01)
*E02F 3/08* (2006.01)
*E02F 3/92* (2006.01)

(52) U.S. Cl.
CPC ..... *E02F 5/109* (2013.01); *E02F 3/08* (2013.01); *E02F 3/9218* (2013.01); *E02F 3/9225* (2013.01); *E02F 5/107* (2013.01)

(58) Field of Classification Search
CPC combination set(s) only.
See application file for complete search history.

(56) References Cited

U.S. PATENT DOCUMENTS 3,238,734 A * 3/1966 Rhodes ..... E02F 5/104 405/159
3,722,224 A 3/1973 Roy
(Continued)

FOREIGN PATENT DOCUMENTS

EP 0072172 A1 2/1983
EP 2787126 A1 10/2014
(Continued)

OTHER PUBLICATIONS

International Search Report and Written Opinion issued in counterpart PCT Application No. PCT/EP2018/070008 and dated Jan. 3, 2019 (nineteen (19) pages).

*Primary Examiner* — Kyle Armstrong
(74) *Attorney, Agent, or Firm* — E. Eric Mills; Nexsen Pruet, PLLC

(57) ABSTRACT

A trench cutting apparatus and method, the apparatus comprising a central support element comprising at least one jetting outlet and a cutting element configured to be driven around the central support element. The trench cutting apparatus is configured to be operable in a mechanical cutting mode in which the cutting element is driven around the central support element to cut material forward of the trench cutting apparatus, and a jet cutting mode in which a pump is activated to eject fluid from the at least one jetting outlet to fluidize or cut material forward of the trench cutting apparatus.

19 Claims, 14 Drawing Sheets

(56) References Cited

U.S. PATENT DOCUMENTS

| | | | | |
|---|---|---|---|---|
| 4,812,079 | A * | 3/1989 | Johnson | E02F 5/104 37/322 |
| 5,349,765 | A | 9/1994 | Kitanaka et al. | |
| 2016/0215476 | A1 | 7/2016 | Walker | |

FOREIGN PATENT DOCUMENTS

| | | | |
|---|---|---|---|
| GB | 2015620 | A | 9/1979 |
| GB | 2104131 | A | 3/1983 |
| JP | 1993280043 | A | 10/1993 |
| JP | 2912826 | Y | 6/1999 |
| JP | 2003500572 | A | 1/2003 |
| JP | 200777649 | A | 3/2007 |
| NL | 7114221 | A | 4/1973 |
| WO | 1999/054556 | A1 | 10/1999 |
| WO | 2000071822 | A1 | 11/2000 |
| WO | 03/023152 | A2 | 3/2003 |
| WO | 2015/032730 | A1 | 3/2015 |

* cited by examiner

TRENCH CUTTING APPARATUS AND METHOD

CROSS REFERENCE TO RELATED APPLICATIONS

This application is a 35 U.S.C. § 371 U.S. national phase entry of International Application No. PCT/EP2018/070008 having an international filing date of Jul. 24, 2018, which claims the benefit of The Netherlands Application No. 2019360 filed Jul. 27, 2017, each of which is incorporated herein by reference in its entirety.

The present invention relates to a trench cutting apparatus and method of cutting a trench. In particular, but not exclusively, the present invention relates to an apparatus and method of cutting a trench, which is suitable for cutting a trench in both relatively hard ground and also relatively loose material or sandy soil.

The formation of trenches in the ground is a well-known requirement and is typically used for burying utility supply means, for example, oil, gas and water pipes, and electricity and telecommunication cables. In underwater environments, the cutting of a trench is often used for burial of pipes and cables and usually utilises specially constructed or adapted equipment configured for underwater conditions, for example the nature of the seabed. Herein "seabed" is used to refer to the bed of the sea or of a lake or even a river, unless otherwise specified.

A wide variety of cable laying and burial equipment is available and can be selected depending on the environment and specific needs (e.g. seabed conditions and burial depth). Various apparatus for constructing a trench and laying a cable or pipe are known in the art. These can include soil cutting devices in the form of ploughs, jetting apparatus, and chain cutters. Jetting is generally suitable for soft or loose soils, whilst mechanical cutting is generally suitable for hard or dense soils. The soil cutting device may be mounted on a vehicle that moves over the ground (e.g. the seabed) either under its own power or by external means. For example, the trench cutting vehicle might be towed by a tractor vehicle or by a ship at the surface of the sea.

When cutting a length of trench, particularly in the seabed, different soil and/or rock types are often encountered along the length of the trench. It is often useful to switch between different types of cutting device for cutting different soil and rock types. For example, a relatively hard rock may cut better using a chain cutter or other mechanical cutting tool, whilst a relatively sandy soil may be cut better using a jetting apparatus.

In the jetting process, a combination of high flow and low pressure water jets may be used to fluidize and displace granular sediment, for example, and low flow and high pressure water jets may be used for cutting and transporting of clay lumps, for example. This process opens a channel into which the cable is allowed to sink.

Mechanical cutting may employ a cutting wheel or a cutting chain to cut a trench in generally compacted seabed or rock. The cable may be placed into the trench behind the trench cutting vehicle as the trench is cut.

Following either of the jetting or mechanical cutting processes, the trench may be back filled to bury the cable.

Currently, when cutting different soil and rock types in a single trench, the trench cutting vehicle may be lifted from the sea bed and the cutting tool replaced with a different cutting tool before the trench cutting vehicle is redeployed to continue cutting. WO2015/032730A1 discloses a trenching vehicle in which a chain cutter may be replaced with a jetting device. However, such a system can cause problems with slack in the cable or pipeline since the cable is continually lifted and placed back down for the cutting tool replacement.

FIGS. 1*a* to 1*f* illustrate the problems with this process. As shown in FIG. 1*a*, the trench cutting vehicle 100 is operating in a mechanical cutting mode with a chain cutter 102 deployed. During the chain cutting process, the cable 104 is lifted to avoid damage to the cable from the chain cutter 102.

As the trench cutting vehicle 100 reaches sandy soil 106, as shown in FIG. 1*b*, the cable 104 is released to the seabed and into the trench and the chain cutter 102 is retracted from the cutting position. The chain cutter 102 is then replaced with a jetting tool 108 and the sandy soil 106 is jetted as shown in FIG. 1*c* until the trench cutting vehicle reaches a region of relatively harder rock 110 or soil.

At this point, as shown in FIG. 1*d*, the jetting tool 108 is replaced with the chain cutter 102 and the cable 104 is lifted before the chain cutter 102 is deployed into the cutting position. The trench cutting vehicle 100 then continues along the seabed in a chain cutting mode. As shown in FIGS. 1*e* and 1*f*, this leaves behind a bump 105 in the cable. After several changes between cutting tools, this can cause problems with increased tension on the cable since the spare cable slack is continually reduced along the trench at each bump. WO99/54556A1 discloses a trenching vehicle having a chain cutter and a jetting tool in position behind the chain cutter. However, with this device it can be difficult to swap between the chain cutter and the jetting tool, and material can fall between the chain cutter and the jetting tool, and thus an eductor is also required to remove material from between the chain cutter and the jetting tool.

It would be useful to provide a trench cutting apparatus that can more easily adapt to cut different types of rock or soil.

According to a first aspect of the present invention there is provided a trench cutting apparatus comprising:

- a central support element comprising at least one jetting outlet; and
- a cutting element configured to be driven around the central support element;

wherein the trench cutting apparatus is configured to be operable in a mechanical cutting mode in which the cutting element is driven around the central support element to cut material forward of the trench cutting apparatus, and a jet cutting mode in which a pump is activated to eject fluid from the at least one jetting outlet to fluidize or cut material forward of the trench cutting apparatus.

Suitably, in the jet cutting mode the position of the cutting element is fixed relative to the central support element.

Suitably, in the jet cutting mode, each of the at least one jetting outlet is aligned with a respective opening in the cutting element such that fluid is ejected through the cutting element.

Suitably, the apparatus further comprises a measuring element to determine alignment of each of the at least one jetting outlet with the respective opening in the cutting element.

Suitably, the apparatus further comprises a controller configured to stop movement of the cutting element such that each of the at least one jetting outlet is aligned with the respective opening in the cutting element.

Suitably, the apparatus further comprises a stopper element for preventing movement of the cutting element in the jet cutting mode.

Suitably, the central support element comprises a plurality of jetting outlets.

Suitably, the at least one jetting outlet is located on a substantially forward facing surface of the central support element.

Suitably, the cutting element comprises a chain cutter and the central support element comprises a support arm.

Suitably, a plurality of jetting outlets are distributed substantially evenly along the length of the support arm on a forward facing surface thereof.

Suitably, the cutting element comprises a rock wheel or shearing drum and the central support element comprises a shaft.

Suitably, the apparatus further comprises a fluid supply inlet coupled to the central support element.

Suitably, the apparatus further comprises the pump configured to pump fluid from the fluid supply inlet, through the central support element and out through the at least one jetting outlet.

Suitably, the pump is configured to eject fluid from the at least one jetting outlet at a pressure of from 0.5 to 25 bar.

Suitably, the trench cutting apparatus is configured to activate the pump during the mechanical cutting mode to thereby eject fluid from the jetting outlets to clean or lubricate the cutting element.

According to a second aspect of the present invention, there is provided a trench cutting vehicle comprising the trench cutting apparatus according to the first aspect.

Suitably, the trench cutting vehicle further comprises a cable support element for supporting an elongate element above the ground distal from the cutting element.

Suitably, the trench cutting vehicle further comprises a share and depressor element configured to guide the elongate element into a cut trench and prevent trench collapse prior to placement of the elongate element in the trench.

According to a third aspect of the present invention there is provided a method of cutting a trench comprising:

cutting the trench with a trench cutting apparatus configured to operate in a mechanical cutting mode and a jet cutting mode, wherein the apparatus comprises a central support element comprising at least one jetting outlet and a cutting element configured to be driven around the central support element;

operating the trench cutting apparatus in at least one of the mechanical cutting mode in which the cutting element is driven around the central support element to cut material forward of the trench cutting apparatus and the jet cutting mode in which a pump is activated to eject fluid from the at least one jetting outlet to fluidize or cut material forward of the trench cutting apparatus.

Suitably, the method further comprises fixing the position of the cutting element with respect to the central support element during the jet cutting mode.

Suitably, the method further comprises aligning each of the at least one jetting outlets with a respective opening in the cutting element in the jet cutting mode such that fluid is ejected through the cutting element.

Apparatus arranged to implement a method in accordance with any preceding claim.

Certain embodiments of the invention provide an apparatus that can more easily switch between cutting of relatively hard rock or soil and relatively loose or sandy soil.

Certain embodiments provide a trenching apparatus in which problems with cable slack are reduced or mitigated.

Certain embodiments provide an apparatus that is easier and quicker to use with reduced time needed for tooling changes.

Certain embodiments provide the advantage that bend radius of a pipe or cable can be better controlled, especially during the jetting process.

Certain embodiments provide the advantage that the trench may be formed quicker than with previously known apparatus or methods.

Embodiments of the invention are further described hereinafter with reference to the accompanying drawings, in which:

FIGS. 1*a* to 1*f* illustrate a known trenching process;

FIG. 2*a* illustrates a sectional view of an example of a trench cutting apparatus;

FIG. 2*b* illustrates a detailed view of section C of FIG. 2*a;*

Figure 10A:
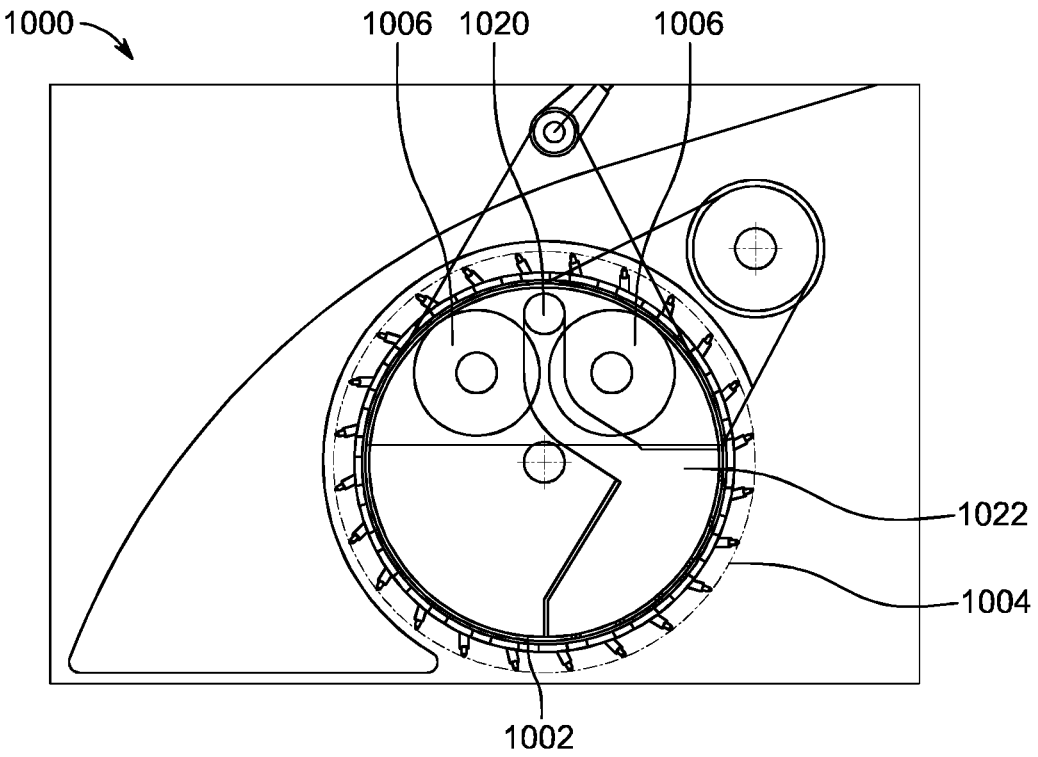
Figure 10B:
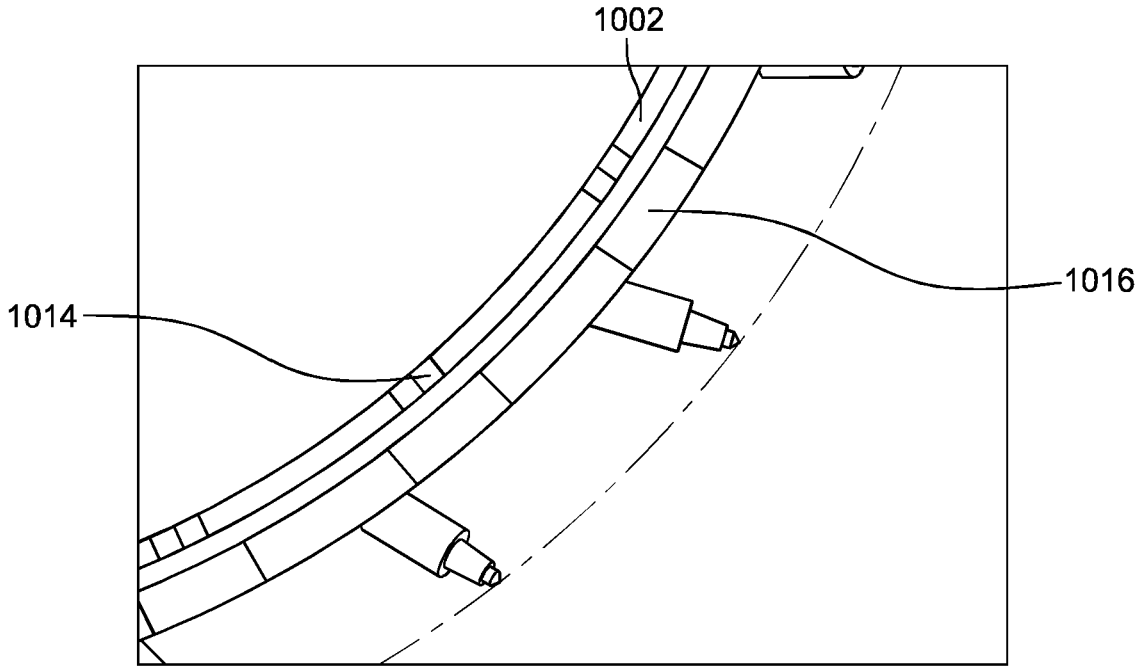
Figure 11:
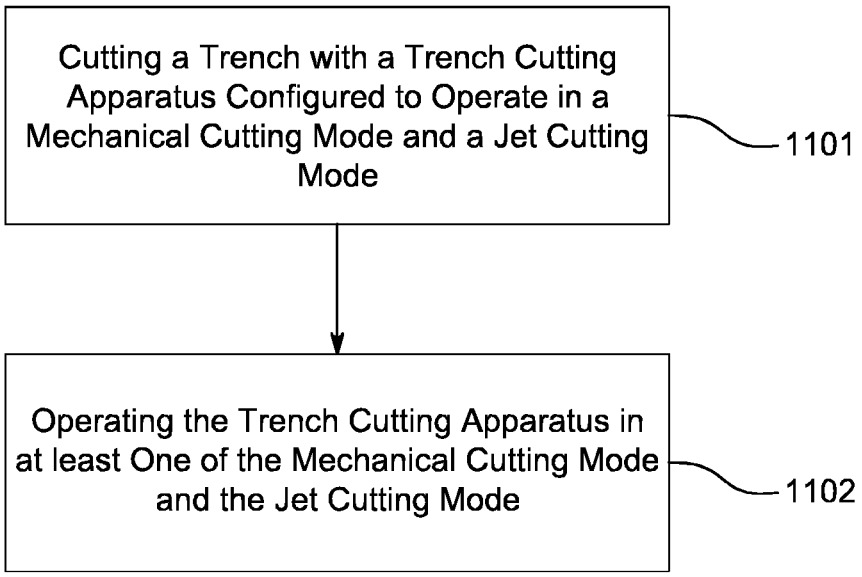

FIGS. 10*a* and 10*b* illustrate another example of a trench cutting apparatus; and FIG. 11 is a flow diagram of a method of cutting a trench.

In the drawings like reference numerals refer to like parts.

Figure 1A:
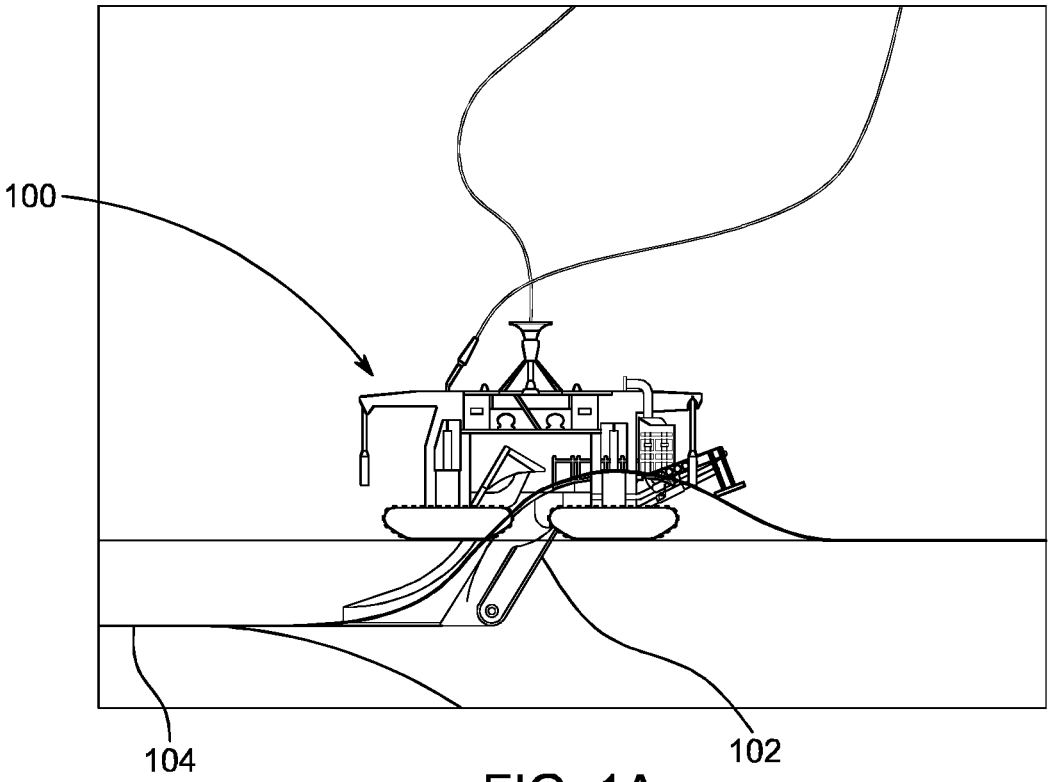
Figure 1B:
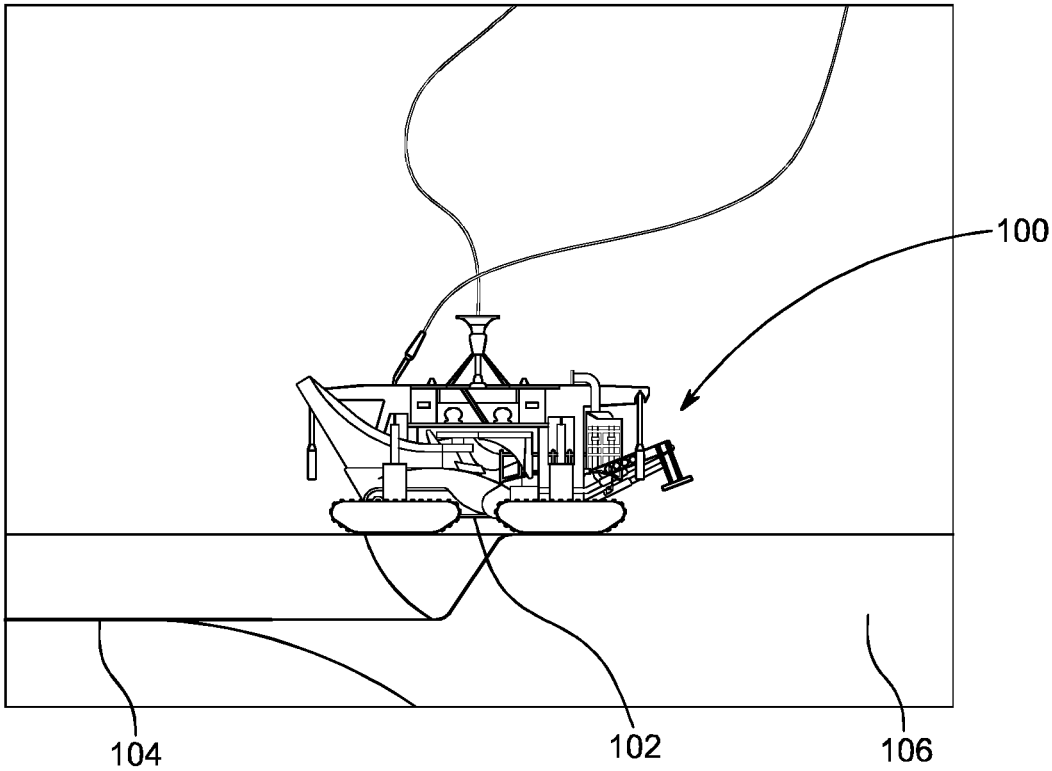
Figure 1C:
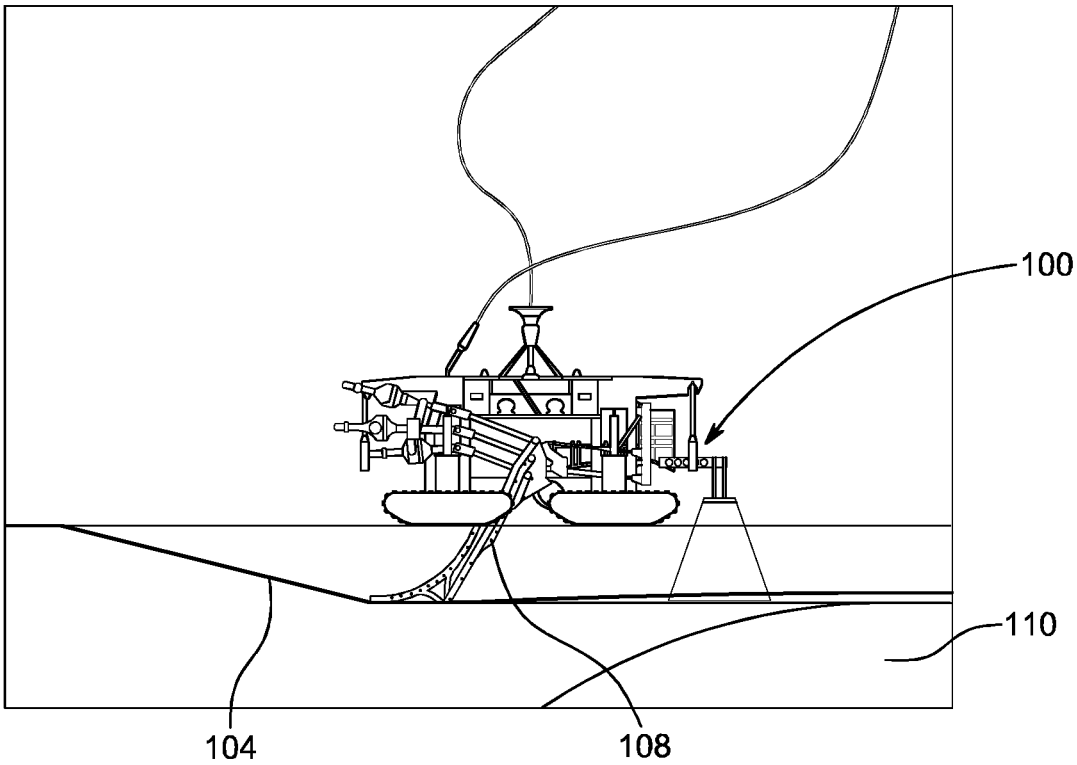
Figure 1D:
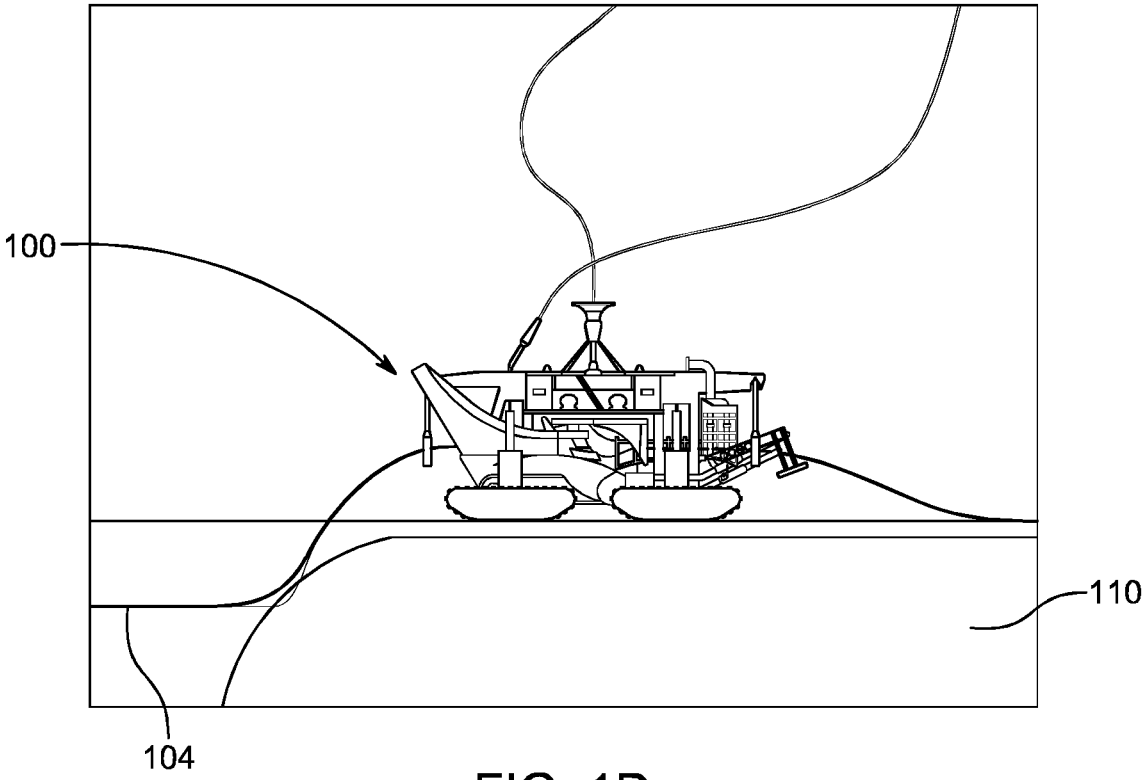
Figure 1E:
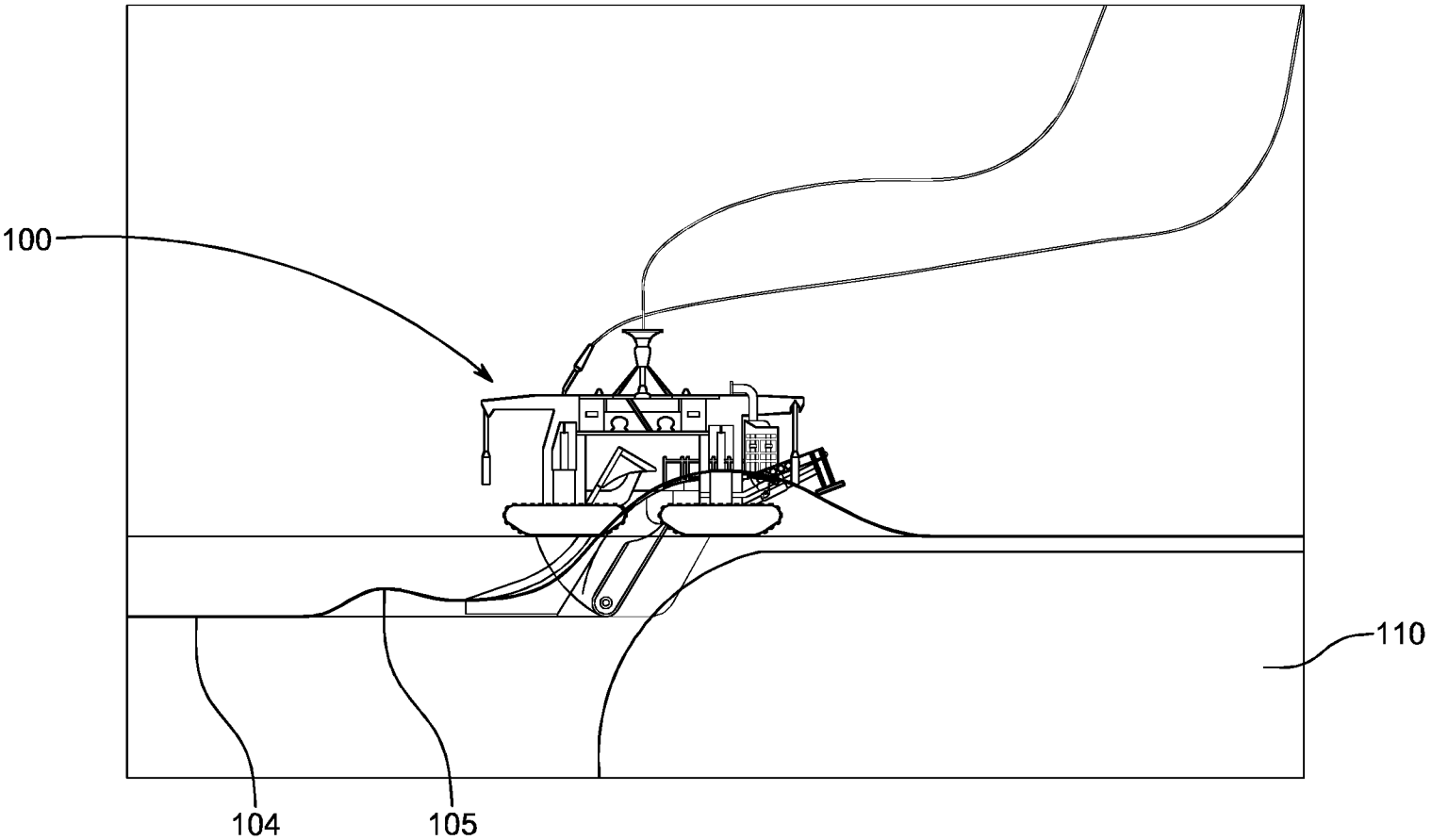
Figure 1F:
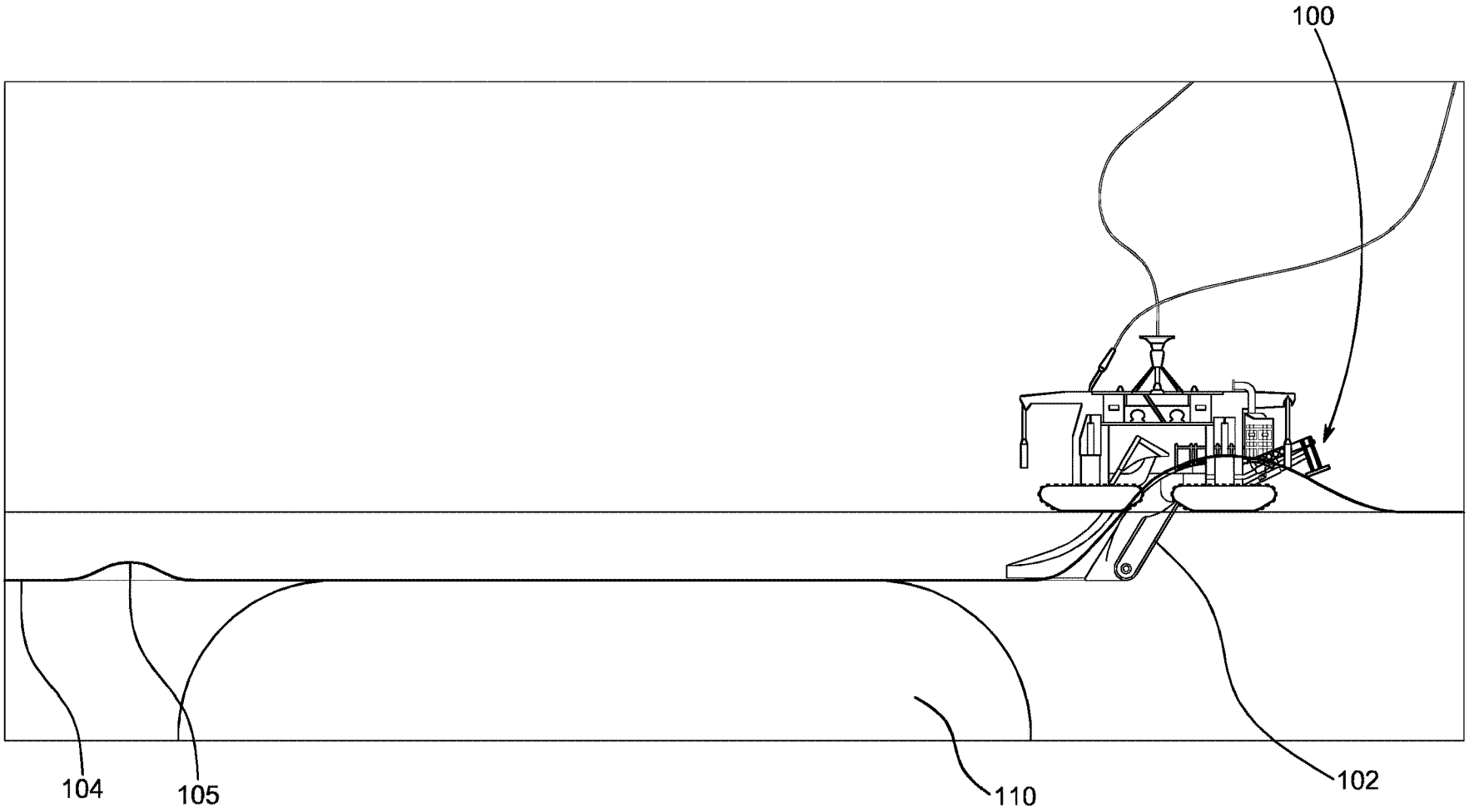
Figure 2A:
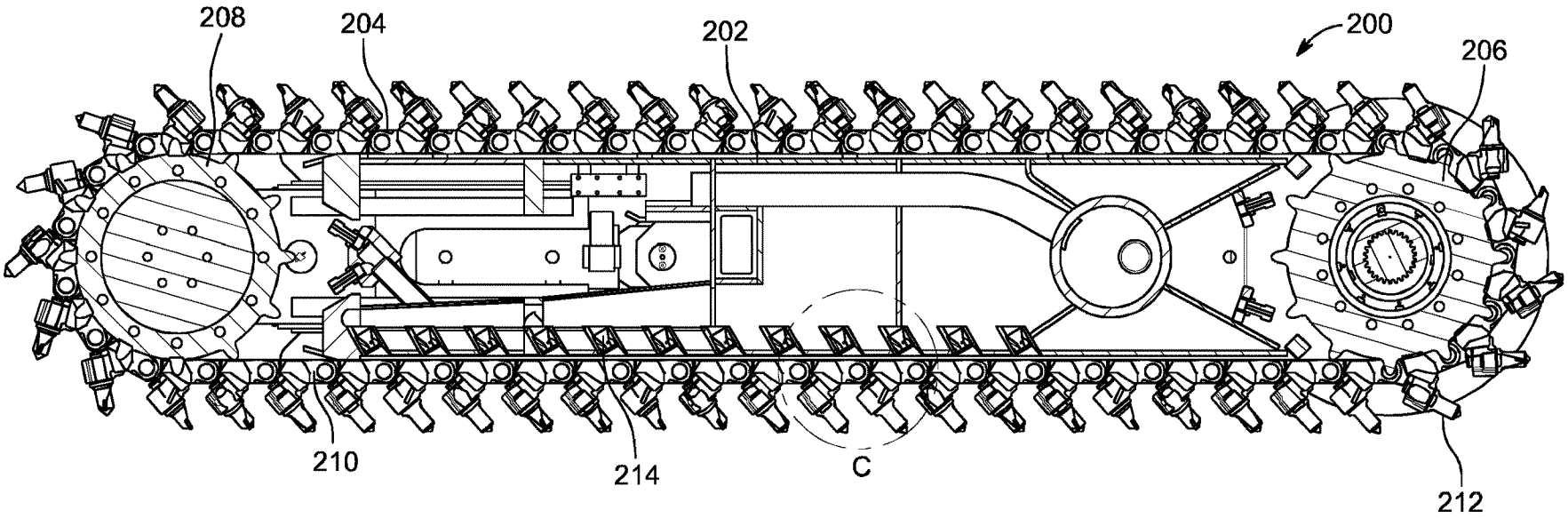

FIG. 2 illustrates an example of a trench cutting apparatus 200. The trench cutting apparatus 200 includes a central support element 202 and a cutting element 204 that is configured to be driven around the central support element 202.

In this example, the central support element 202 is a support arm and the cutting element 204 is a chain cutter that is configured to be driven around the support arm. The support arm 202 includes one or more drive sprockets. In this example a drive sprocket 206 is located at a first end of the support arm 202 and a further sprocket 208 at a second end of the support arm 202 distal to the first end. In other examples, instead of a further sprocket 208, an idler (e.g. a wheel or pulley that guides the chain cutter 204 around the support arm) may be provided at the second end of the support arm 202. The drive sprocket 206 is connected to a drive element (e.g. a motor), which actuates rotation of the drive sprocket 206 to drive the chain cutter 204 around the support arm 202.

The chain cutter 204 includes a chain element 210 and a plurality of cutting heads 212 coupled to the chain element 210. The cutting heads 212 are configured to mechanically cut through ground or seabed material when the chain cutter 204 rotates about the support arm 202.

Figure 2B:
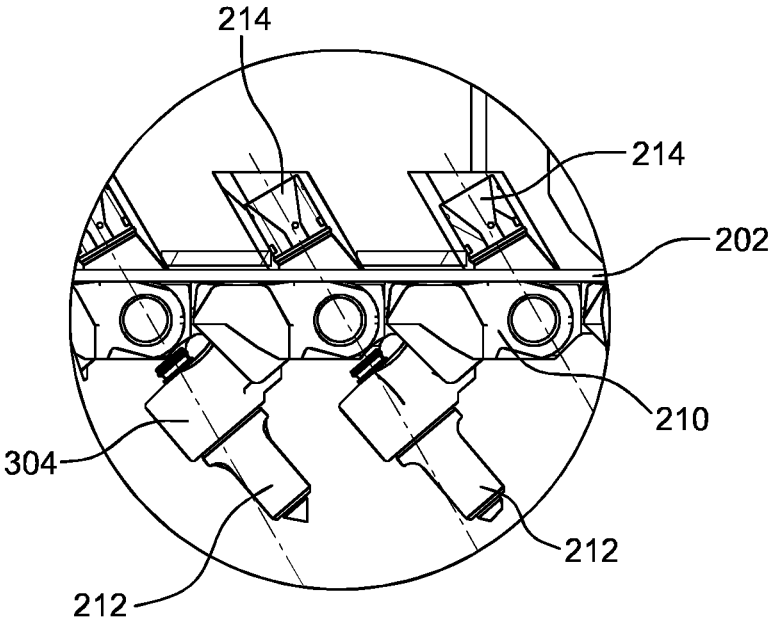
Figure 8:
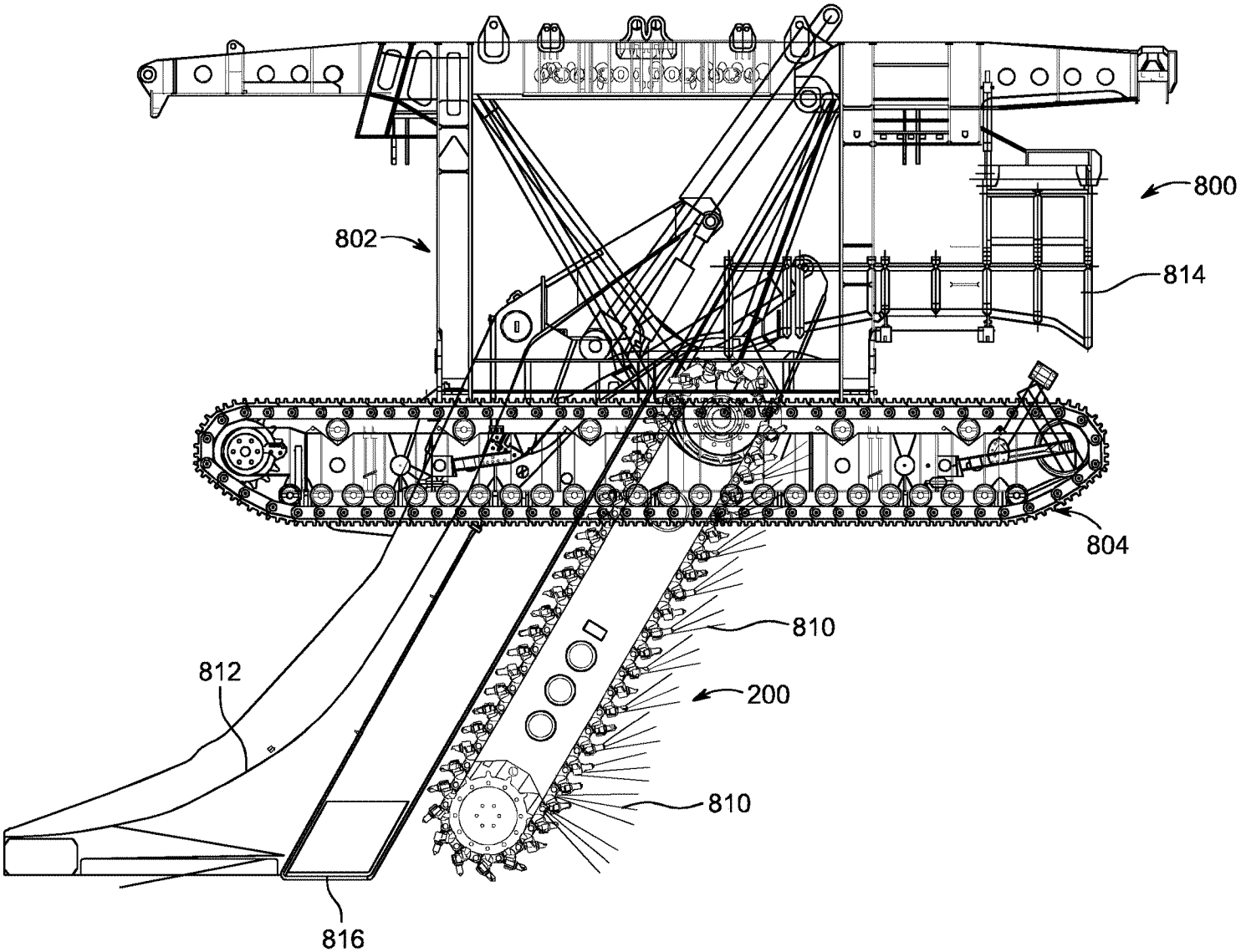
FIG. 8 illustrates a side view schematic of an example of a trench cutting vehicle.

The central support element 202 includes at least one jetting outlet 214. In this example, a plurality of jetting outlets 214 are distributed along the length of the support arm 202. Turning to FIG. 2*b*, each of the jetting outlets 214 are oriented to face substantially forward of the trench cutting apparatus 200 when in use (the position and orientation of the apparatus when in use is shown in FIG. 8), such that fluid ejected from the jetting outlets 214 fluidizes or cuts material substantially forward of the trench cutting apparatus 200. In this example, the jetting outlets 214 are located on a substantially forward facing surface of the support arm 202. The jetting outlets 214 are aptly located and oriented such that jetting via the jetting outlets 214 can efficiently fluidize or cut the seabed material and assist in transporting the displaced material from the trench.

Figure 3:
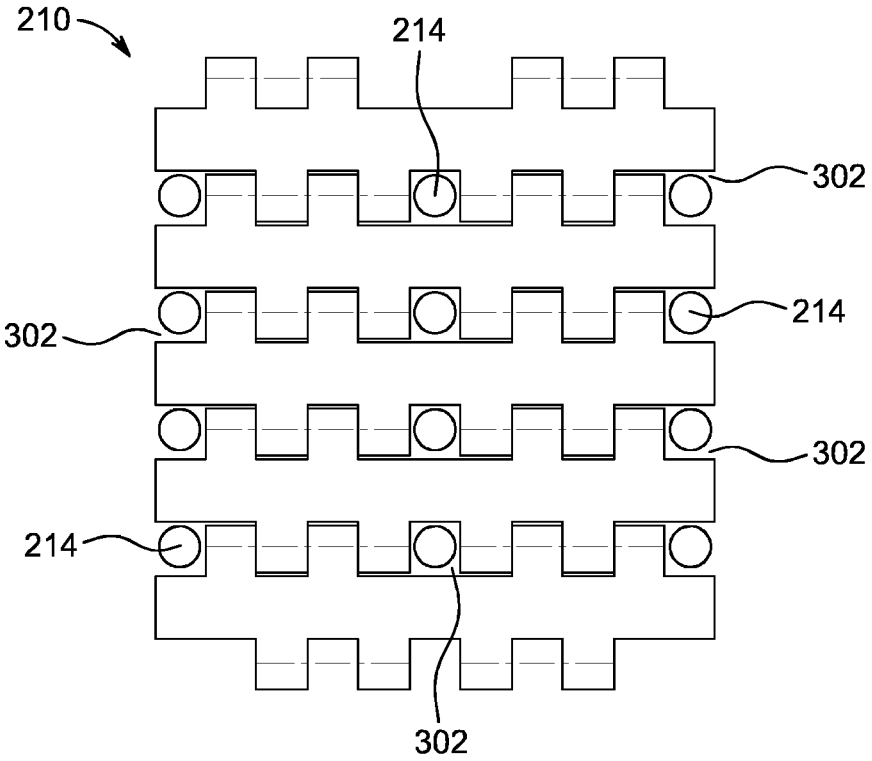
FIG. 3 illustrates an example of a chain element.

As shown in FIG. 3, the chain element 210 is configured to include openings 302. The openings may be positioned to align with the jetting outlets 214 such that fluid may be ejected from the jetting outlets 214 and through the openings 302 in the chain element 210.

The chain element 210 also includes coupling links 304 (see FIG. 2*b*) for coupling the cutting heads 212 to the chain element 210. The coupling links 304 in this example each include a recess into which a cutting head 212 can be held in position by mechanical means. In this way, the cutting heads 212 can be replaced once they become blunt from wear. In this example, the cutting heads 212 are each conically shaped picks and are held in the recess in a way that allows them to rotate.

The trench cutting apparatus 200 can operate in both a mechanical cutting mode and a jet cutting mode. In the mechanical cutting mode, the cutting element 204 (in this example the chain cutter) is driven around the central support element 202 to cut material forward of the trench cutting apparatus 200. That is, as the cutting element 204 is driven around the central support element 202, the cutting element 204 cuts material in front of the trench cutting apparatus 200 in the direction of travel of the trench cutting apparatus 200.

In the jet cutting mode, a pump (not shown) is activated to eject fluid from the jetting outlets 214. The trajectory of the ejected fluid (jets) is substantially forward of the trench cutting apparatus 200. The ejected fluid thereby fluidizes or cuts material forward of the trench cutting apparatus 200 and can assist in transporting displaced material away from the trench.

In some examples, one or more of the jetting outlets (e.g. in an upper portion of the central support element) may be positioned such that the direction of the jets have an upward component to assist in soil transportation. Similarly some of the jetting outlets (e.g. in a lower portion of the central support element) may be positioned such that the directions of the jets have a downward component. This can help to assist in fluidizing the bottom of the trench. At least some of the jetting outlets may be positioned such that the direction of the jets have a significant lateral component (i.e. forward of the device). This can help to ensure that the full face width of the trench is cut or fluidized.

As such, in both the mechanical cutting mode and the jet cutting mode, the trench cutting apparatus is configured to cut material forward of the apparatus (in front of the apparatus in the direction of travel). Thus, the trench cutting apparatus 200 is able to continually cut material forward of the apparatus to cut a continuous trench.

In the mechanical cutting mode, the jetting outlets are aptly inactive (i.e. do not eject any fluid) and the cutting element 204 is driven around the central support element 202. When switching to the jet cutting mode, the jetting outlets 214 are activated (i.e. fluid is ejected). A pump may control the ejection of the fluid from the jetting outlets 214 and may also control the pressure at which the fluid is ejected. For example, fluid may be ejected at a pressure between 0.5 bar and 25 bar, or more suitably between 0.5 bar and 16 bar. Aptly, the fluid may be ejected at a pressure between around 2 bar and 5 bar to most efficiently fluidize material.

As discussed above, the cutting element 204 may include openings 302 through which the fluid may be ejected. Suitably, in the jet cutting mode, the rotational speed of the cutting element 204 around the central support element 202 may be significantly reduced compared to the mechanical cutting speed or may be completely stopped relative to the central support element 202.

Figure 4:
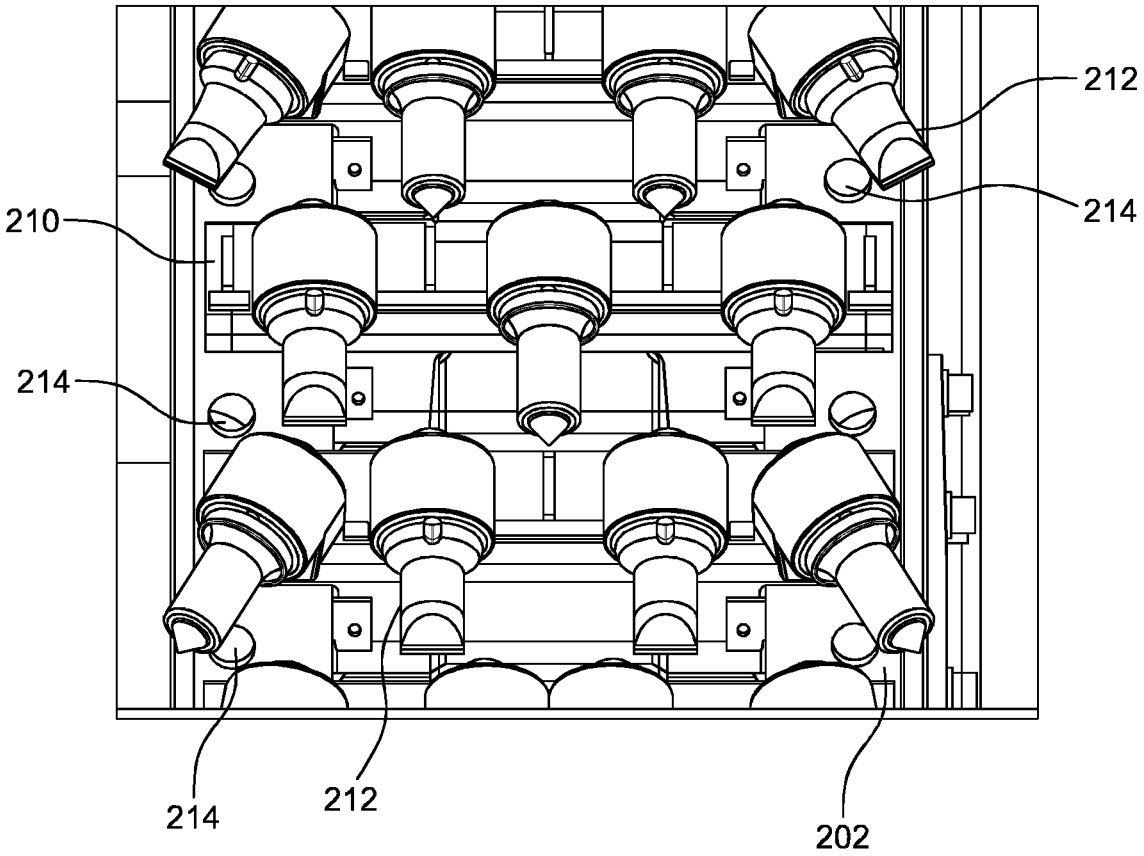
FIG. 4 illustrates a view of a forward facing surface of an example of a trench cutting apparatus.

Aptly, during the jet cutting mode, the position of the cutting element 204 is fixed relative to the central support element 202. The cutting element 204 may aptly be aligned with the central support element 202 and the jetting outlets 214. The alignment may be such that the jetting outlets 214 each align with a respective opening 302 in the cutting element 204 such that fluid may be ejected through the cutting element 204 (see FIG. 4). Aptly, the position of the cutting element 204 is fixed relative to the central support element 202. This can help to ensure that during the jet cutting mode, fluid is ejected from the jetting outlets 214 in the forward direction and the trajectory is not affected by the cutting element 204 blocking the path.

Figure 5:
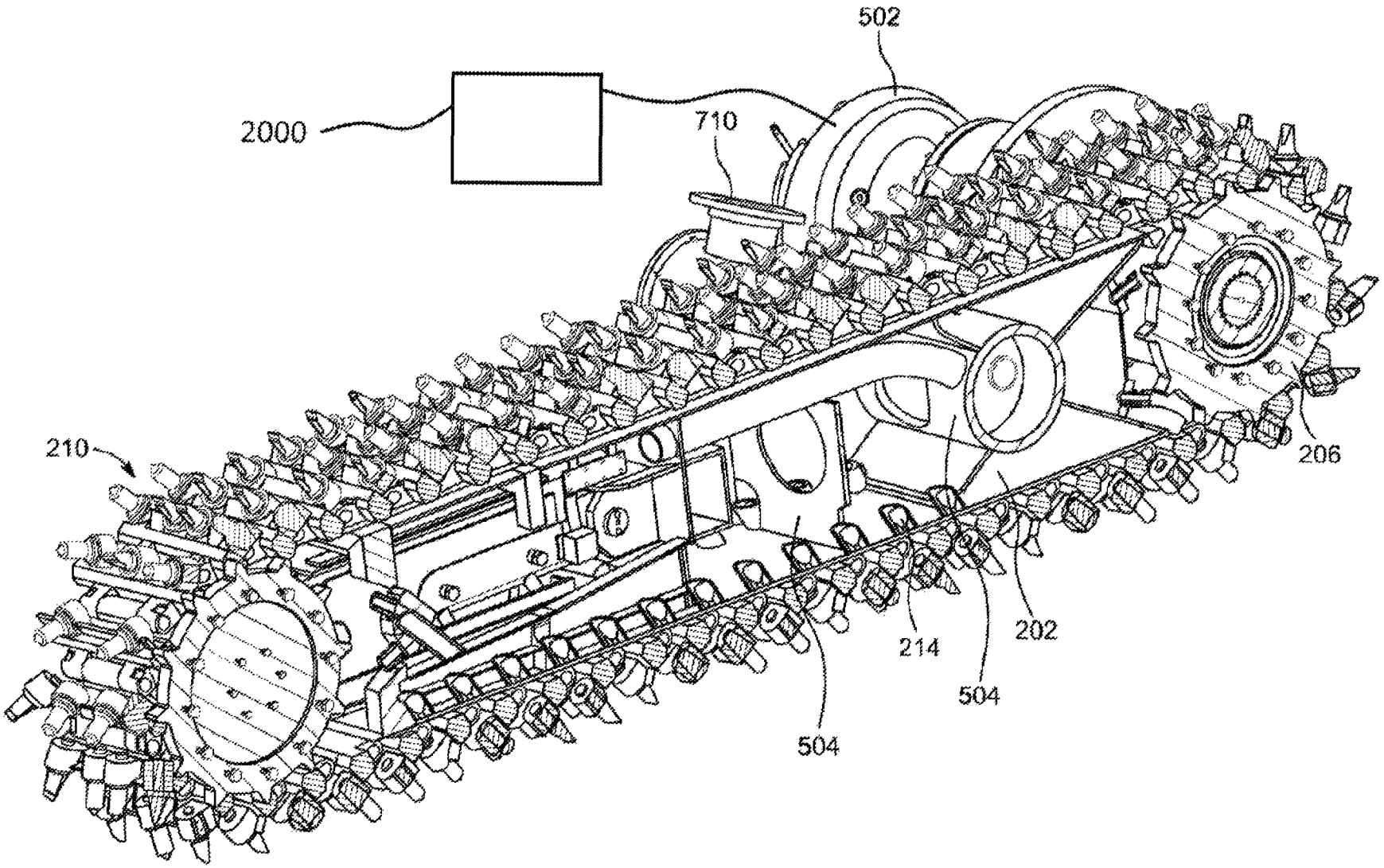
FIG. 5 illustrates a cut through perspective view of an example of a trench cutting apparatus.
Figure 6:
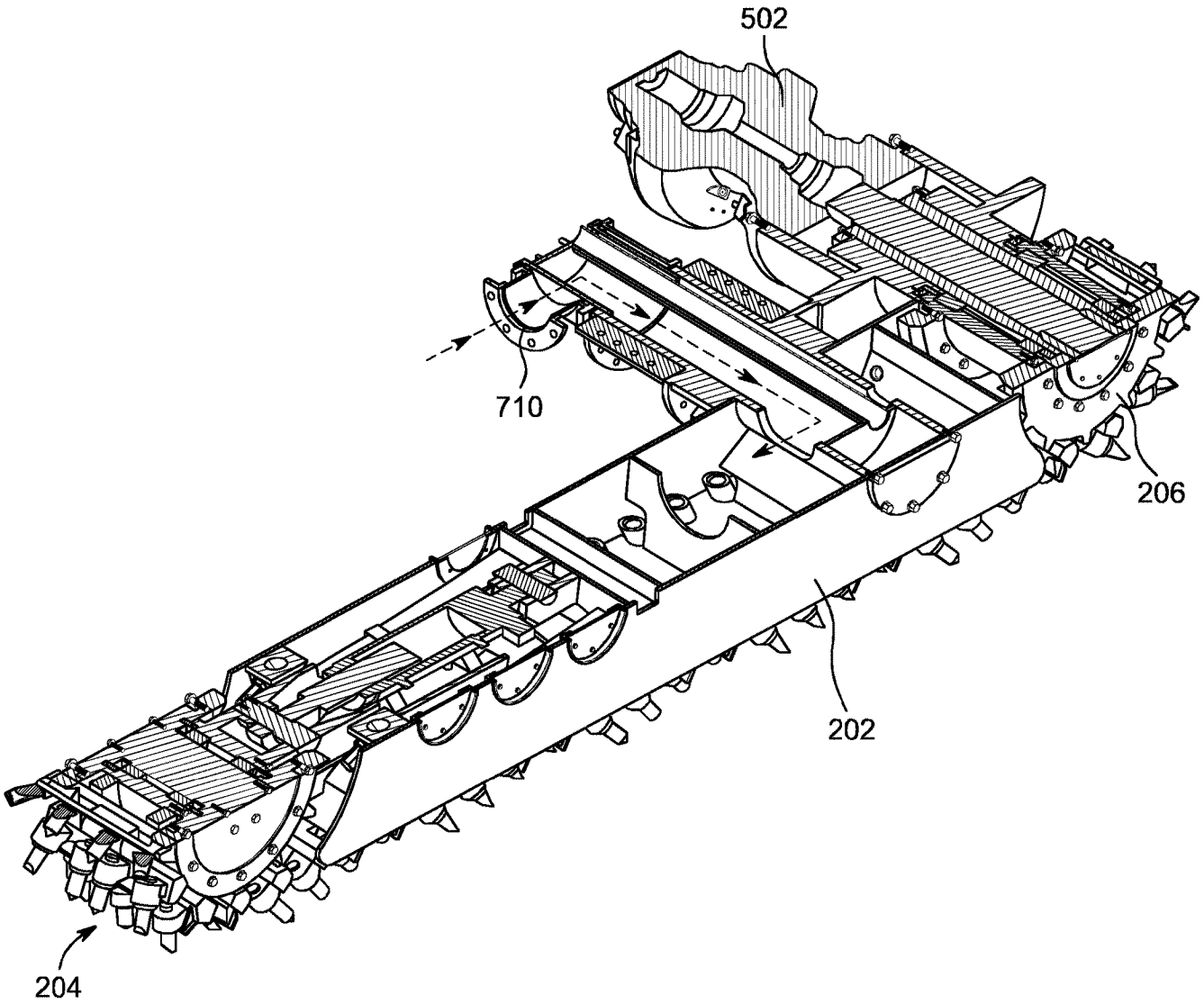
FIG. 6 illustrates another cut through perspective view of the trench cutting apparatus of FIG. 5.
Figure 7:
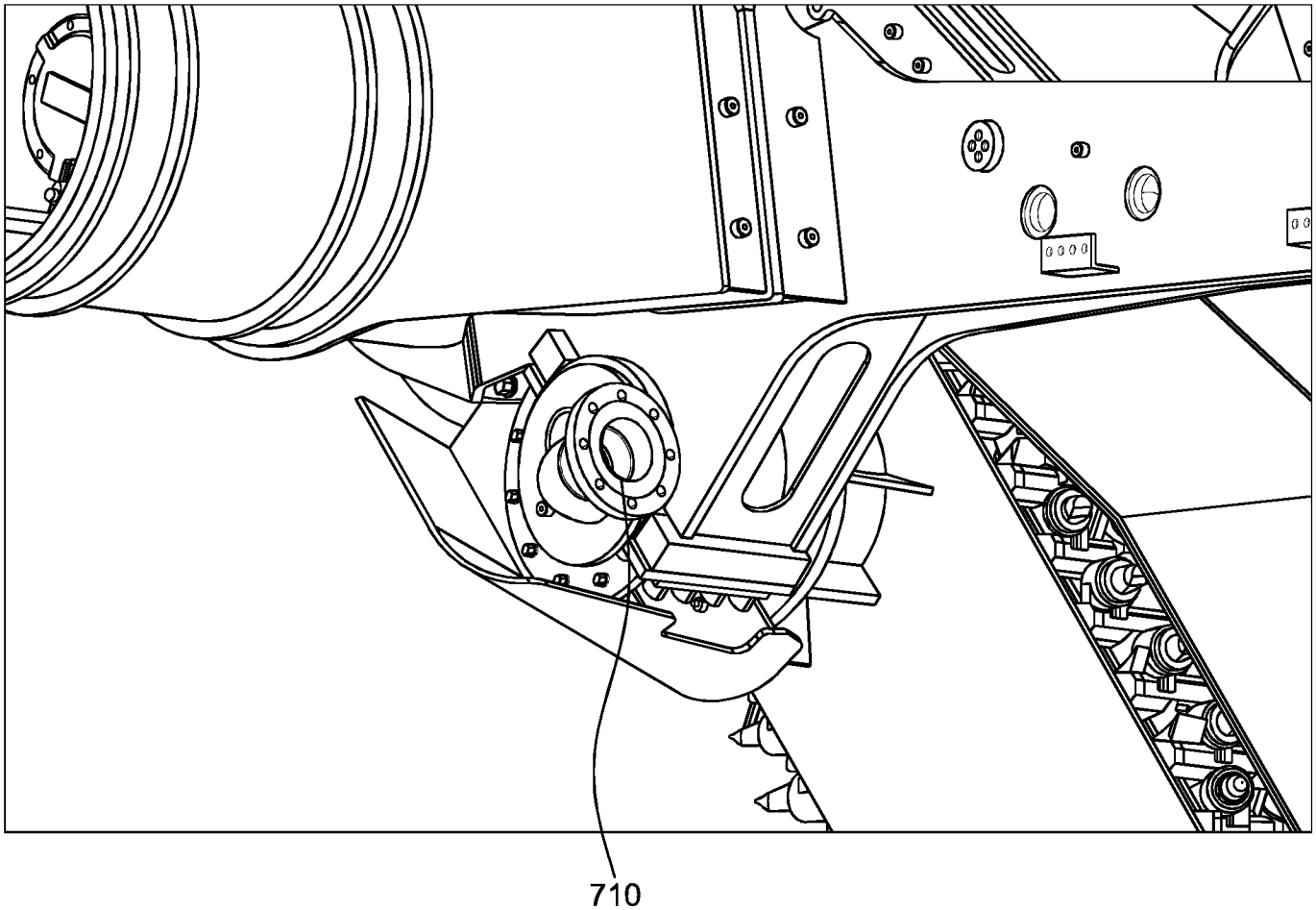
FIG. 7 illustrates an example fluid inlet of a trench cutting apparatus.

Referring now to FIGS. 5 to 7, the operation of the trench cutting apparatus 200 will be described in more detail.

As shown in FIG. 5, the drive sprocket 206 is coupled to a motor 502. The motor 502 may be any conventional motor configured to apply a torque to the drive sprocket 206. The motor 502 is active in the mechanical cutting mode to drive the sprocket 206 and thereby drive the cutting element 204 around the support element 202.

In order to determine alignment of the jetting outlets 214 with the respective openings 302 in the cutting element 204 in the jet cutting mode, a measuring element may be provided. The measuring element may be included in the motor, and may include a toothed wheel.

The toothed wheel includes a plurality of teeth about the circumference and can thereby detect rotational distances (and speed etc.) by a non-contact proximity sensor or an encoder, for example. The measuring element may determine the alignment of the jetting outlets and openings according to the rotational position of the toothed motor. Alternatively or additionally, the trench cutting apparatus may include a controller 2000 that is configured to stop movement of the cutting element 204 such that each of the jetting outlets 214 are aligned with a respective opening in the cutting element 204.

A stopper element (e.g. a mechanical stopper) may alternatively or additionally be provided to prevent movement of the cutting element in the jet cutting mode. For example, the stopper element may be configured to prevent rotation of one or both of the sprockets 206, 208 during the jet cutting mode. The mechanical stopper may include a mechanical location device, for example a block, to prevent rotation of the cutting element 204 by engaging one or more of the sprockets or the cutting element in an otherwise unengaged location.

The trench cutting apparatus also includes a fluid supply inlet 710. In this example, the fluid supply inlet is coupled to a side of the central support element 202. A pump may be provided to pump fluid from the fluid supply inlet 710 from the surrounding environment (e.g. the surrounding sea water) into the central support element 202 and out through the jetting outlets 214. As is shown by the dotted arrows in FIG. 6, fluid may enter the central support element 202 via the fluid supply inlet 710. The jetting outlets 414 are provided in a forward facing wall of the central support element 202. As such, as the fluid is pumped into the central support element under pressure, it is ejected via the jetting outlets 214.

Aptly, the central support element 202 and the fluid supply inlet 710 are configured to minimise the change in cross-section and flow as the fluid passes to the jetting outlets 214. This helps to avoid energy dissipation and allows for a more efficient device. As is shown most clearly in FIGS. 5 and 6, in this example, the central support element 202 includes an internal flow structure 504 configured to guide the fluid flow through the central support element 202 and to the jetting outlets 214. The internal flow structure 504 may help to improve flow through the central support element 202 and reduce mechanical stress, which may be induced by pressure of fluid.

Figure 9:
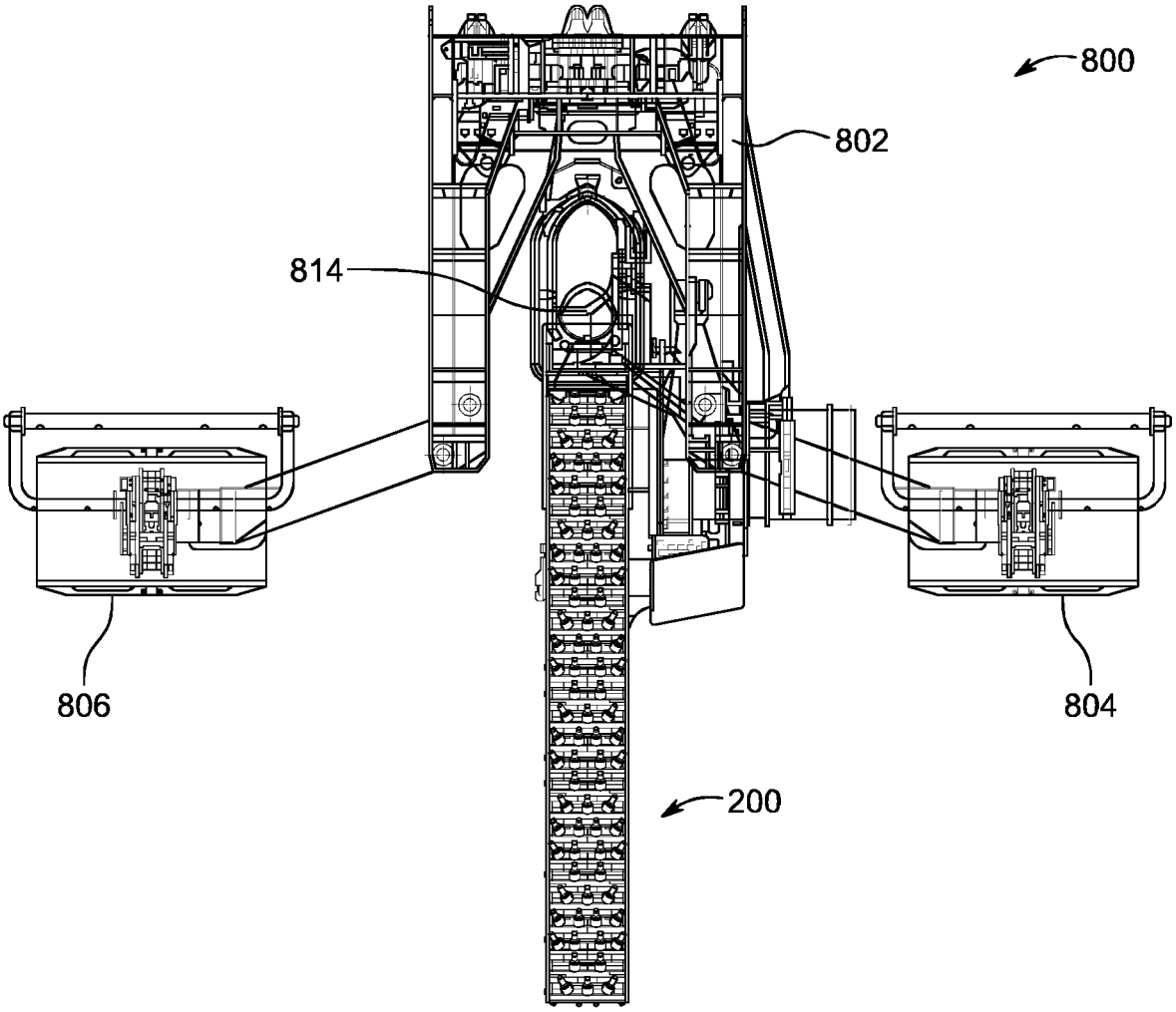
FIG. 9 illustrates a front view schematic of the trench cutting vehicle of FIG. 8.

FIGS. 8 and 9 illustrate a trench cutting vehicle 800 including the trench cutting apparatus 200. The trench cutting vehicle 800 includes a main body portion 802. First and second ground contacting elements 804, 806 are coupled to the main body portion 802. The ground contacting elements 804, 806 are configured to apply tractive force to the ground (or seabed) to move the trench cutting vehicle along the ground (or seabed). In this example each of the ground contacting elements 804, 806 include endless tracks. It will be appreciated that in other examples, more than two ground contacting elements may be used, for example four ground contacting elements or six ground contacting elements.

The trench cutting apparatus 200 is coupled to the main body portion 802. As shown in FIGS. 8 and 9, the trench cutting apparatus 200 extends downwardly from the main body portion 802, for cutting a trench in the ground (or seabed) on which the ground contacting elements 804, 806 sit. Aptly, the trench cutting apparatus 200 may be configured to retract from the cutting position. This can help to enable the vehicle to initially land on the seabed prior to cutting the trench. In addition, retraction of the trench cutting apparatus 200 after trenching helps to enable efficient recovery and storage of the vehicle on a vessel.

As shown in FIG. 8, in the jet cutting mode, jets 810 of fluid are ejected in a substantially forward direction to cut or fluidize material forward of the trench cutting apparatus 200. A share (or cofferdam) element 812 is coupled to the main body portion 802 rear of the trench cutting apparatus 200. The share element 812 is configured to prevent trench collapse prior to placement of a cable in the trench by supporting the trench walls until the cable is positioned in the bottom of the trench. A depressor element 816 is configured to guide a cable into the trench. The depressor element 816 can be opened to allow cable to be loaded. The share element 812 and depressor element 816 may also be retracted from the deployed position shown in FIG. 8 to a stored position by means of a hydraulic arm, for example.

The trench cutting vehicle 800 also includes a cable support element 814 configured to support a cable above the ground distal from the trench cutting apparatus 200. The cable support element 814 is coupled to the main body portion 802 and is arranged to guide the cable over the trench cutting apparatus 200 and to the depressor 816. The depressor 816 can then guide the cable downwards and into the trench.

Because the trench cutting apparatus can operate in both a mechanical cutting mode and a jet cutting mode, there is no requirement to lift the trench cutting vehicle from the seabed to swap between mechanical and jet cutting modes. Thus a cable can remain supported in the cable support element 814 throughout the whole of the trench cutting operation. As such, the required cable slack can be established at the beginning of the trench cutting operation and carried by the trench cutting vehicle 800 along the whole length of the trench.

FIG. 11 illustrates a method of cutting a trench. As shown at 1101 the method includes cutting the trench with a trench cutting apparatus configured to operate in a mechanical cutting mode and a jet cutting mode. The apparatus includes a central support element including at least one jetting outlet and a cutting element configured to be driven around the central support element. For example, the apparatus may be the trench cutting apparatus 200 shown in FIG. 2. However, the method may use any of the other suitable apparatus described herein.

At 1102 the method includes operating the trench cutting apparatus in at least one of the mechanical cutting mode and the jet cutting mode. In the mechanical cutting mode the cutting element is driven around the central support element to cut material forward of the trench cutting apparatus. In the jet cutting mode a pump is activated to eject fluid from the at least one jetting outlet to fluidize or cut material forward of the trench cutting apparatus. Various modifications to the detailed designs as described above are possible. For example, although the cutting element has been described above as a chain cutter, other cutting elements may also be suitable. FIGS. 10*a* and 10*b* illustrate an example of a trench cutting apparatus 1000 in which the cutting element is a rock wheel 1004. Similarly to the chain cutter, the rock wheel is configured to rotate about a central support element, which in this example is a hollow cylindrical shaft 1002. Rotation of the rock wheel 1004 is controlled at the circumference of the rock wheel by drive motors 1006.

The shaft 1002 includes jetting outlets 1014 on a substantially forward facing portion of the surface of the shaft. Similarly to the chain cutter described above, the rock wheel may include openings 1016 that can align with the jetting outlets 1014 in the jet cutting mode such that fluid may be ejected from the jetting outlets 1014 and through the openings 1016 in the rock wheel 1004.

The trench cutting apparatus includes a fluid inlet 1020 through which fluid is drawn into the shaft 1002. In this particular example, the shaft 1002 includes a fluid reservoir 1022 into which the fluid is drawn. The fluid may be drawn directly from surrounding seawater via a suitable pumping device or alternatively the fluid inlet may be connected to a remote fluid supply.

During the jetting mode, a pump is activated to eject fluid from the jetting outlets. The pump may also draw the fluid into the shaft 1002 via the fluid inlet 1020. The trench cutting apparatus 1000 may operate in the jet cutting mode and the mechanical cutting mode in a similar manner to the trench cutting apparatus 200 described above.

In another example, the cutting element may be a shearing drum. The shearing drum may operate similarly to the rock wheel described above, with the main difference being that the shearing drum is driven at the centre of the shaft rather than at the circumference.

In some examples, the trench cutting apparatus may be configured to activate the pump during the mechanical cutting mode to thereby eject fluid from the jetting outlets to clean or lubricate the cutting element, for example the chain cutter of FIGS. 2 to 9 discussed above. The power usage of the apparatus may be reconfigured remotely so that if the soil, or other material to be cut does not require all of the power to go the cutting element in the mechanical cutting mode, then a portion of the power can be redirected to the pump to supply fluid to the jetting outlets. Thus, the fluid ejected from the jetting outlets in the mechanical cutting mode can help to lubricate or clean the cutting element, which may reduce wear on the cutting element. In addition, transportation of the cut material may be more effective, and displacement of cut soil by the fluid can reduce the cutting forces associated with the fluid motion (e.g. pore pressure and soil dilating effects).

The trench cutting apparatus described above may be provided coupled to a trench cutting vehicle as shown in FIGS. 8 and 9, or alternatively may be provided separately and retrofitted to a suitable vehicle. It will be appreciated that different vehicle types may be used for different applications depending on the terrain and environment in which the trench is to be cut.

Although in the example described above a particular chain element configuration is shown, it will be appreciated that other chain element configurations may also be suitable. Aptly the chain element is configured such that the cutting elements may be coupled to the chain element, though in other examples the cutting elements may be integral with the chain element. The chain element is aptly configured to have at least the same number of openings as jetting outlets so that each opening may align with a corresponding jetting outlet during the jet cutting mode.

Although the example described above includes a drive sprocket and a further sprocket, in other examples multiple drive sprockets and/or multiple further sprockets may be provided. For example, two drive sprockets may be provided with one drive sprocket located at either side of the chain element. Similarly, two further sprockets may be provided with one further sprocket located at either side of the chain element. In other examples, three or more drive sprockets and/or further sprockets may be provided.

Aptly, the trench cutting apparatus includes a plurality of jetting outlets. The jetting outlets are suitably distributed substantially evenly on a forward facing surface of the central support element. Suitably, a line of jetting elements are provided along either side of the central support element, e.g. along either side of the forward facing surface of the support arm.

In other examples, the trench cutting apparatus may include only a single jetting outlet. For example, the jetting outlet may be an elongate outlet extending along a surface of the central support element. In this way, an elongate jet of fluid may be ejected from the jetting outlet, to fluidize or cut material forward of the trench cutting apparatus.

The pump described above may form part of the jet cutting apparatus or alternatively may be provided externally to the jet cutting apparatus (e.g. as part of a trench cutting vehicle). Although in the examples described above, the cutting element is described as aptly fixed relative to the central support element during the jet cutting mode, it will be appreciated that in some examples the cutting element may continue to move relative to the central support element during the jet cutting mode. For example, the speed of the cutting element relative to the jet cutting mode may be reduced compared to the mechanical cutting mode such that a combined jet cutting and mechanical cutting mode is achieved.

Although a cable or pipe may be specifically referred to herein, it will be appreciated that the apparatus described above may be suitable for laying any elongate element in a trench.

With the above described arrangement, a cable may be supported throughout the entire trench cutting process. As such, the minimum bend radius of the cable can be controlled, thereby reducing risk of damage to the cable during the trenching process.

By supporting the cable throughout the entire trenching process, the cable slack can be established at the beginning of the process and carried along the length of the trench. Since the cable does not need to be released throughout the trenching process for tooling changes, the slack can be better controlled, thereby reducing risk of over tensioning the cable.

The above described trench cutting apparatus can easily switch between a mechanical cutting mode and a jet cutting mode as necessary. Thus, the most effective cutting mode can be activated according to the material to be cut. This can thus reduce wear on the cutting apparatus, and particularly the cutting element when cutting relatively loose or sandy material, or material of relatively low cohesive strength.

In the above described arrangement, problems with trench infill between a mechanical cutter and a jetting tool is eliminated since the two tools are combined into a single trench cutting apparatus. This helps reduce the risk of soil or rock falling into the trench before the cable is positioned in the trench. Therefore the chances of having to re-lay portions of the cable that are not deep enough within the trench are reduced. Thus, time taken for the overall trenching process can be significantly reduced.

With the above described systems, cable, pipe or other elongate element or product can be placed at the bottom of a trench in a relatively uniform and level position. This can reduce strain on the product, which may thereby improve the serviceable lifetime of the product.

It will be clear to a person skilled in the art that features described in relation to any of the embodiments described above can be applicable interchangeably between the different embodiments. The embodiments described above are examples to illustrate various features of the invention.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A trench cutting apparatus comprising:

a central support element comprising at least one jetting outlet; and a cutting element configured to be driven around the central support element;

wherein the trench cutting apparatus is operable in a mechanical cutting mode in which the cutting element is driven around the central support element to cut material in front of the trench cutting apparatus in the direction of travel, and a jet cutting mode in which a pump is activated to eject fluid from the at least one jetting outlet to fluidize or cut material in front of the trench cutting apparatus in the direction of travel, wherein in the jet cutting mode a position of the cutting element is fixed relative to the central support element such that movement of the cutting element around the central support element is prevented.

2. The trench cutting apparatus according to claim 1, wherein in the jet cutting mode, each of the at least one jetting outlet is aligned with a respective opening in the cutting element such that fluid is ejected through the cutting element.

3. The trench cutting apparatus according to claim 2, further comprising a measuring element to determine alignment of each of the at least one jetting outlet with the respective opening in the cutting element.

4. The trench cutting apparatus according to claim 2, further comprising a controller configured to stop movement of the cutting element such that each of the at least one jetting outlet is aligned with the respective opening in the cutting element.

5. The trench cutting apparatus according to claim 1, further comprising a stopper element for preventing movement of the cutting element in the jet cutting mode.

6. The trench cutting apparatus according to claim 1, wherein the central support element comprises a plurality of jetting outlets.

7. The trench cutting apparatus according to claim 1, wherein the at least one jetting outlet is located on a substantially forward facing surface of the central support element.

8. The trench cutting apparatus according to claim 1, wherein the cutting element comprises a chain cutter and the central support element comprises a support arm.

9. The trench cutting apparatus according to claim 8, wherein a plurality of jetting outlets are distributed substantially evenly along the length of the support arm on a forward facing surface thereof.

10. The trench cutting apparatus according to claim 1, wherein the cutting element comprises a rock wheel or shearing drum and the central support element comprises a shaft.

11. The trench cutting apparatus according to claim 1, further comprising a fluid supply inlet coupled to the central support element.

12. The trench cutting apparatus according to claim 11, further comprising the pump configured to pump fluid from the fluid supply inlet, through the central support element and out through the at least one jetting outlet.

13. The trench cutting apparatus according to claim 12, wherein the pump is configured to eject fluid from the at least one jetting outlet at a pressure of from 0.5 to 25 bar.

14. The trench cutting apparatus according to claim 1, wherein the trench cutting apparatus is configured to activate the pump during the mechanical cutting mode to thereby eject fluid from the jetting outlets to clean or lubricate the cutting element.

15. The trench cutting vehicle comprising the trench cutting apparatus of claim 1.

16. The trench cutting vehicle according to claim 15, further comprising a cable support element for supporting an elongate element above the ground distal from the cutting element.

17. The trench cutting vehicle according to claim 15, further comprising a share and depressor element configured to guide the elongate element into a cut trench and prevent trench collapse prior to placement of the elongate element in the trench.

18. A method of cutting a trench comprising:

cutting the trench with a trench cutting apparatus configured to operate in a mechanical cutting mode and a jet cutting mode, wherein the apparatus comprises a central support element comprising at least one jetting outlet and a cutting element configured to be driven around the central support element;

operating the trench cutting apparatus in at least one of the mechanical cutting mode in which the cutting element is driven around the central support element to cut material in front of the trench cutting apparatus in the direction of travel and the jet cutting mode in which a pump is activated to eject fluid from the at least one jetting outlet to fluidize or cut material in front of the trench cutting apparatus in the direction of travel;

fixing a position of the cutting element with respect to the central support element during the jet cutting mode such that movement of the cutting element around the central support element is prevented.

19. The method according to claim 18, further comprising aligning each of the at least one jetting outlets with a respective opening in the cutting element in the jet cutting mode such that fluid is ejected through the cutting element.

* * * * *